US008555434B2

(12) United States Patent
Chapman et al.

(10) Patent No.: US 8,555,434 B2
(45) Date of Patent: Oct. 15, 2013

(54) RECONFIGURABLE CHILD RETAINING STRUCTURE

(75) Inventors: Linda J. Chapman, Corfu, NY (US); Timothy J. Trapp, Orchard Park, NY (US)

(73) Assignee: Mattel, Inc., El Segundo, CA (US)

( * ) Notice: Subject to any disclaimer, the term of this patent is extended or adjusted under 35 U.S.C. 154(b) by 11 days.

(21) Appl. No.: 13/332,573

(22) Filed: Dec. 21, 2011

(65) Prior Publication Data

US 2012/0180211 A1 Jul. 19, 2012

Related U.S. Application Data

(60) Provisional application No. 61/427,227, filed on Dec. 27, 2010.

(51) Int. Cl.
*A47D 7/00* (2006.01)
*A47D 13/06* (2006.01)

(52) U.S. Cl.
USPC ..... 5/93.2; 5/99.1

(58) Field of Classification Search
USPC ..... 5/93.1, 93.2, 99.1, 100, 655, 2.1
See application file for complete search history.

(56) References Cited

U.S. PATENT DOCUMENTS

| | | | | |
|---|---|---|---|---|
| 2,247,598 | A | | 7/1941 | Bohlen |
| 2,260,584 | A | | 10/1941 | Schuck et al. |
| 2,287,907 | A | | 6/1942 | Schettler, Jr. |
| 2,641,772 | A | * | 6/1953 | Cook ..... 5/93.1 |
| 2,706,299 | A | | 4/1955 | Sespico |
| 2,784,420 | A | | 3/1957 | Moltane |
| 3,096,917 | A | | 7/1963 | Gudiksen |
| 3,127,620 | A | | 4/1964 | Peterson |
| 3,163,870 | A | | 1/1965 | Scotney, III |
| 3,187,352 | A | | 6/1965 | Gottlieb |
| 3,680,155 | A | | 8/1972 | McMann |
| 3,699,594 | A | | 10/1972 | Matthey-Doret |
| 3,848,277 | A | | 11/1974 | Reguitti |
| 4,097,942 | A | | 7/1978 | Bridger |
| D274,390 | S | | 6/1984 | Shakas |
| 4,508,519 | A | | 4/1985 | Becker |
| 4,651,367 | A | | 3/1987 | Osher et al. |
| 4,935,976 | A | | 6/1990 | Milman |
| 5,025,517 | A | * | 6/1991 | Johnson ..... 5/99.1 |
| 5,339,470 | A | | 8/1994 | Shamie |
| 5,544,870 | A | * | 8/1996 | Kelley et al. ..... 256/26 |
| 5,560,055 | A | | 10/1996 | Ziegler |
| 5,615,434 | A | * | 4/1997 | Cracchiolo et al. ..... 5/658 |
| 5,727,265 | A | | 3/1998 | Ziegler |
| 5,778,465 | A | | 7/1998 | Myers |
| 5,867,850 | A | | 2/1999 | Mariol |

(Continued)

FOREIGN PATENT DOCUMENTS

| | | | |
|---|---|---|---|
| JP | 11089680 | A | 4/1999 |
| JP | 2004283196 | A | 10/2004 |

*Primary Examiner* — Robert G Santos
*Assistant Examiner* — Richard G Davis
(74) *Attorney, Agent, or Firm* — Edell, Shapiro & Finnan LLC

(57) ABSTRACT

A child retaining structure includes a wall assembly defining a child receiving area, a platform disposed within the child receiving area, and a support member connected to the wall assembly and supporting the platform. The support member and the platform are reconfigurable between a raised position so that the child retaining structure functions as a bassinet, and a lowered position so that the child retaining structure functions as a playpen, or alternatively, as a playhouse.

20 Claims, 8 Drawing Sheets

(56) References Cited

U.S. PATENT DOCUMENTS

| | | | | |
|---|---|---|---|---|
| 6,058,528 | A | 5/2000 | Yang | |
| 6,076,205 | A | 6/2000 | Yang | |
| 6,131,218 | A | 10/2000 | Wang | |
| 6,182,308 | B1 | 2/2001 | Yang | |
| 6,233,759 | B1 | 5/2001 | Warner, Jr. et al. | |
| 6,301,731 | B1 | 10/2001 | Jakubowski et al. | |
| 6,434,767 | B1 | 8/2002 | Welsh, Jr. | |
| 6,526,608 | B1 | 3/2003 | Hsia | |
| 6,539,563 | B1 | 4/2003 | Hsia | |
| 6,574,812 | B2 * | 6/2003 | Jakubowski et al. | 5/658 |
| 6,588,033 | B1 | 7/2003 | Welsh, Jr. | |
| 6,735,796 | B2 | 5/2004 | Warner, Jr. et al. | |
| D500,213 | S | 12/2004 | DeHart et al. | |
| 6,848,129 | B1 * | 2/2005 | Amato et al. | 5/99.1 |
| 6,877,173 | B2 | 4/2005 | Tharalson | |
| 6,907,626 | B1 | 6/2005 | Welsh, Jr. | |
| 6,961,968 | B2 | 11/2005 | Clapper et al. | |
| 7,003,821 | B2 | 2/2006 | DeHart et al. | |
| 7,175,497 | B2 | 2/2007 | Herzog | |
| 7,216,379 | B2 | 5/2007 | Tharalson | |
| 7,228,575 | B2 | 6/2007 | Chen | |
| D554,871 | S | 11/2007 | Volk et al. | |
| 7,346,943 | B2 | 3/2008 | Chen | |
| 7,376,993 | B2 * | 5/2008 | Myers et al. | 5/655 |
| 7,418,745 | B2 | 9/2008 | Paesang et al. | |
| 7,509,694 | B2 | 3/2009 | Chen | |
| 7,818,832 | B2 | 10/2010 | Hartenstine et al. | |
| 7,971,596 | B2 * | 7/2011 | Morris et al. | 135/96 |
| 2002/0092094 | A1 | 7/2002 | Welsh, Jr. | |
| 2002/0152550 | A1 * | 10/2002 | Tharalson et al. | 5/95 |
| 2003/0154547 | A1 | 8/2003 | Hsia | |
| 2003/0177575 | A1 | 9/2003 | Cheng et al. | |
| 2004/0205892 | A1 * | 10/2004 | Raphael-Davis et al. | 5/93.1 |
| 2006/0075550 | A1 | 4/2006 | Hanson | |
| 2006/0207023 | A1 | 9/2006 | DeHart et al. | |
| 2006/0225204 | A1 | 10/2006 | Bretschger | |
| 2007/0061961 | A1 | 3/2007 | Shamie | |
| 2008/0271243 | A1 | 11/2008 | Burkholder et al. | |
| 2008/0271244 | A1 | 11/2008 | Bergkvist | |
| 2010/0058535 | A1 | 3/2010 | Fiore, Jr. | |
| 2010/0229300 | A1 | 9/2010 | Eirich et al. | |
| 2010/0229301 | A1 | 9/2010 | Arnold, IV et al. | |
| 2012/0073044 | A1 * | 3/2012 | Lake | 5/99.1 |

* cited by examiner

RECONFIGURABLE CHILD RETAINING STRUCTURE

CROSS-REFERENCE TO RELATED APPLICATIONS

This application claims the benefit of and priority under 35 U.S.C. 119(e) to U.S. Provisional Application No. 61/427,227, entitled "Reconfigurable Child Retaining Structure", filed Dec. 27, 2010, the disclosure of which is incorporated herein by reference in its entirety.

FIELD OF THE INVENTION

The present invention relates to a child retaining structure, and in particular, a child retaining structure that is reconfigurable between a bassinet mode, a playpen mode, and a playhouse mode.

BACKGROUND OF THE INVENTION

Various child support structures are known in the art, such as for example bassinets, playpens, playhouses, cribs, etc. Conventional support structures are typically relatively bulky and limited to a particular mode of operation. As a result, a parent or care giver often uses a separate bassinet, playpen, and playhouse. There is a need for a structure which may be reconfigured for several modes of operation, thereby eliminating the need for the corresponding separate support structures.

SUMMARY OF THE INVENTION

The present invention relates to a child retaining structure including a wall assembly having opposing first and second end walls and opposing first and second sidewalls. The wall assembly defines a child receiving area. A brace is removably connectable to the opposing first and second end walls in a first position and in a second position. In one implementation, the brace is a first brace, and the child retaining structure includes a second brace connected to and extending between the opposing first and second end walls. A platform is supported on the brace in the first position so that the child retaining structure functions as a bassinet. Alternatively, the platform may be supported on the brace in the second position so that the child retaining structure functions as a playpen.

In one embodiment, the brace is removably connectable to the opposing first and second end walls in a third position. The platform is supported on the brace in the third position so that the child retaining structure functions as a playhouse. In one implementation, an arched roof member is removably coupled to and extends between the opposing first and second sidewalls.

In one embodiment, the first end wall includes a door pivotal between an open position permitting access through the wall assembly to the child receiving area and a closed position restricting access through the wall assembly to the child receiving area. In one implementation, the door is retained in its closed position when the brace is connected to the opposing first and second end walls in the first position. A first end of the brace is connected to the door and an opposite second end of the brace is connected to the second end wall.

In one embodiment, a safety latch is operably coupled to the door and configured to retain the door in the closed position unless actuated by a caregiver. Once the door is disposed in its open position, the safety latch prevents the door from moving back to its closed position unless the safety latch is actuated by a caregiver.

In one embodiment, the first and second end walls are hingedly connected to the first and second sidewalls. The first sidewall includes a first section pivotally connected to a second section via a first hinged coupling, and the second sidewall includes a third section pivotally connected to a fourth section via a second hinged coupling. In one implementation, the first hinged coupling is axially offset from the second hinged coupling, so that the wall assembly is reconfigurable between a deployed position and a folded position. The opposing first and second end walls and the first and second sidewalls are collapsed inwardly when the wall assembly is disposed in its folded position. In one implementation, the major surfaces of the first and second end walls are substantially parallel to each other when the wall assembly is disposed in its folded position.

In one embodiment, the child retaining structure also includes an arched toy bar extending between and removably connected to the opposing first and second sidewalls (or the opposing first and second end walls). The child retaining structure may also include one or more activity panels coupled to or defined by an interior surface(s) of the wall assembly and within the child receiving area.

The present invention also relates to a child retaining structure including a first end wall, a second end wall, and first and second sidewalls. The first sidewall includes a first section hingedly connected to the first end wall and a second section hingedly connected to the second end wall. The first section is pivotally connected to the second section via a first hinged coupling. The second sidewall includes a third section hingedly connected to the first end wall and a fourth section hingedly connected to the second end wall. The third section is pivotally connected to the fourth section via a second hinged coupling. The second hinged coupling is axially offset from the first hinged coupling.

In one embodiment, the child retaining structure also includes a support member removably connectable to the first and second end walls. The first and second sections of the first sidewall are substantially coplanar when the support member is connected to the first and second end walls. The third and fourth sections of the second sidewall are substantially coplanar and the first sidewall is substantially parallel to the second sidewall when the support member is connected to the first and second end walls.

The present invention is also directed to a child retaining structure including a wall assembly defining a child receiving area, a platform disposed within the child receiving area, and a support member connected to the wall assembly and supporting the platform. The support member and the platform are reconfigurable between a raised position so that the child retaining structure functions as a bassinet and a lowered position so that the child retaining structure functions as a playpen.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
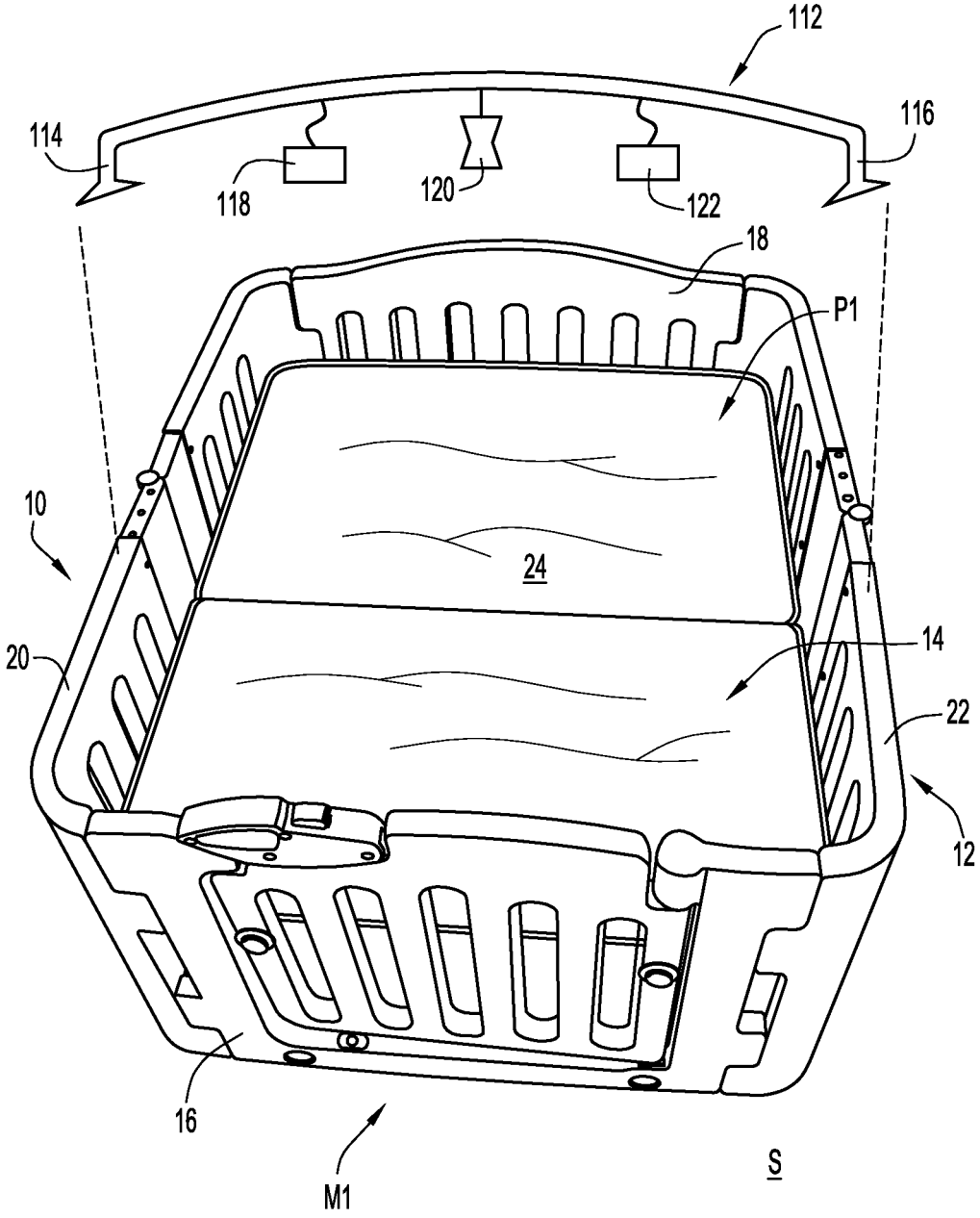
FIG. 1 illustrates a perspective view of a child retaining structure according to an embodiment of the present invention, and configured in its bassinet mode.
Figure 2:
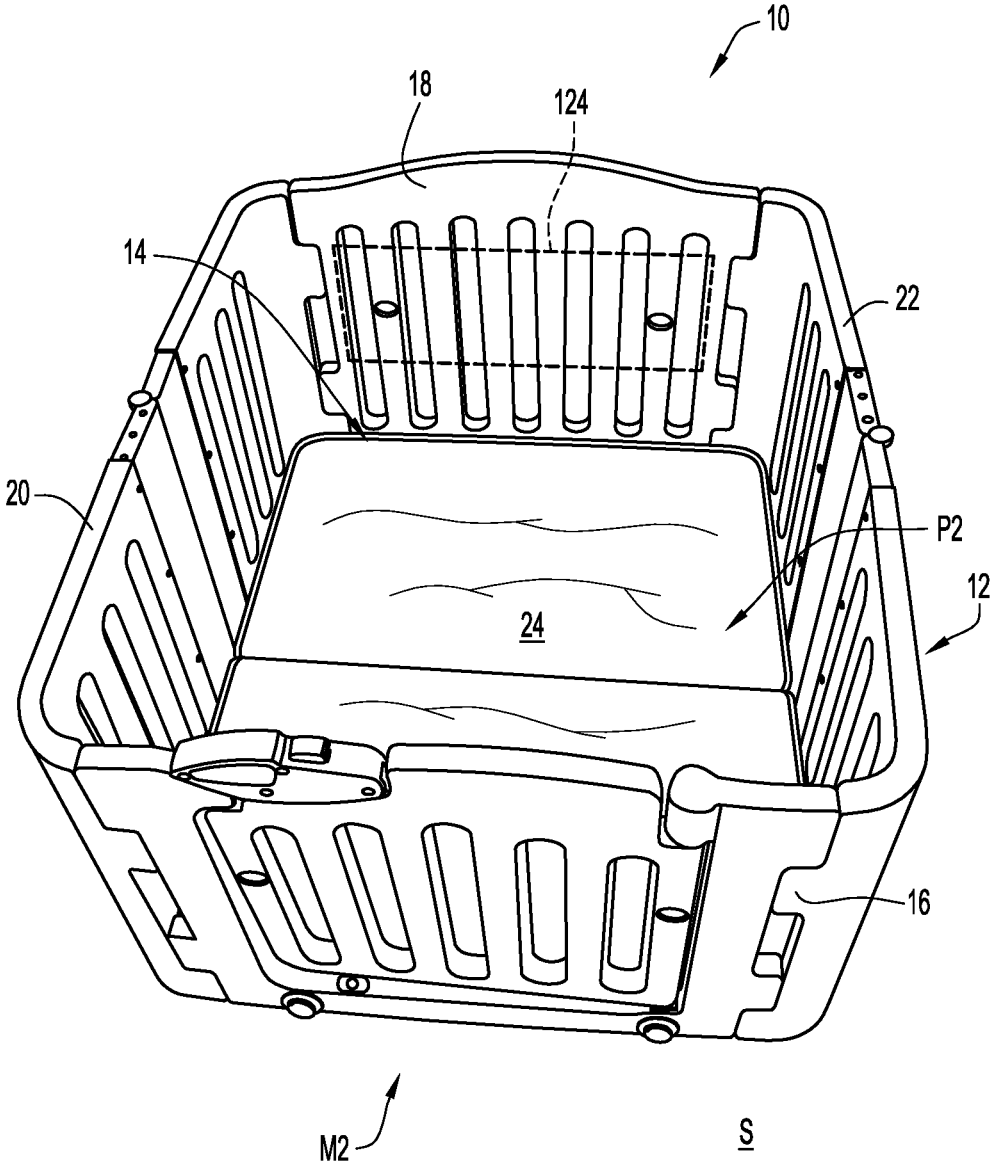
FIG. 2 illustrates a perspective view of the child retaining structure of FIG. 1, and configured in its playpen mode.

FIGS. 1 and 2 illustrate a child retaining structure 10 according to an embodiment of the present invention. The child retaining structure 10 includes a wall assembly 12 defining a child receiving area 14. The wall assembly 12 includes opposing end walls 16, 18 and opposing sidewalls 20, 22.

A platform 24 is disposed within the child receiving area 14, and repositionable between a raised position P1 relative to a support surface S (shown in FIG. 1) and a lowered position P2 relative to the support surface S (shown in FIG. 2). When the platform 24 is disposed in its raised position P1, the child retaining structure 10 is configured in a bassinet mode M1. When the platform 24 is disposed in its lowered position P2, the child retaining structure is configured in a playpen mode M2.

Figure 3:
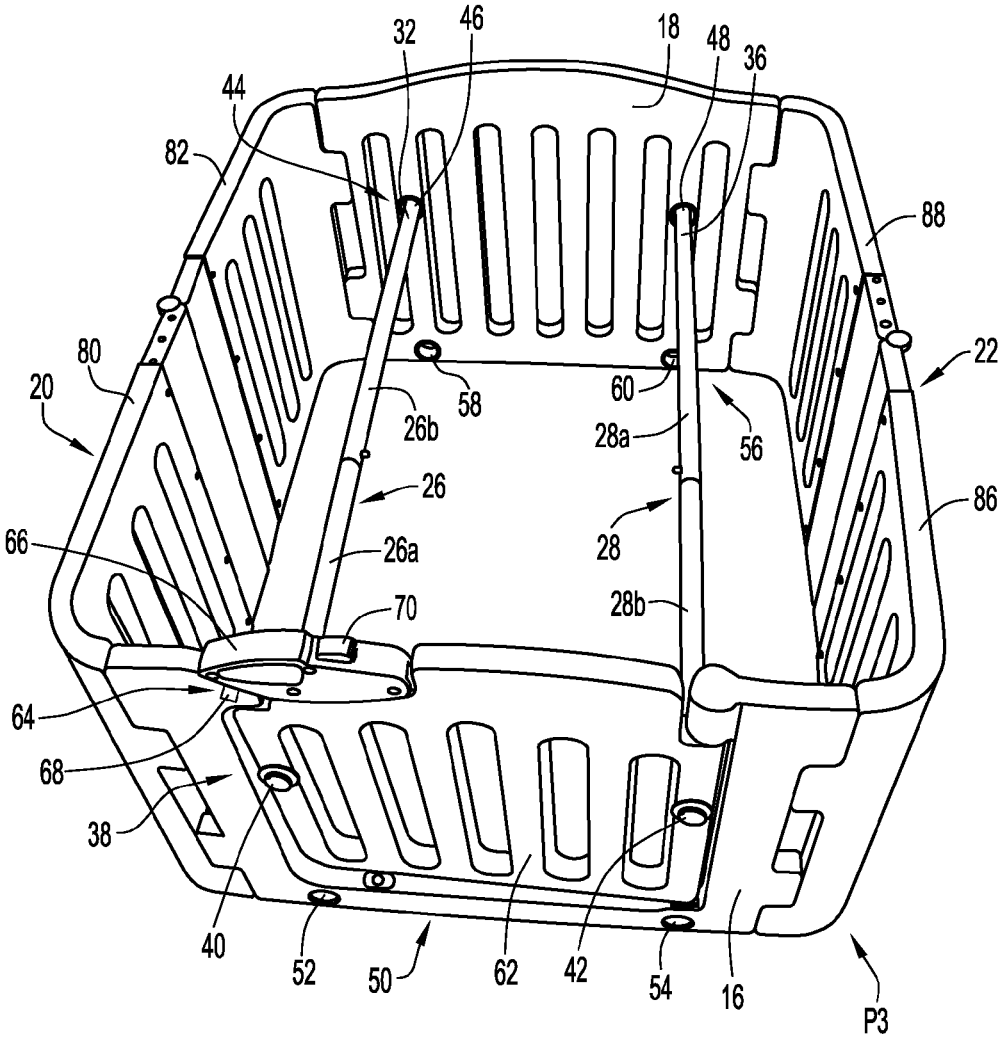
FIG. 3 illustrates a perspective view of components of the child retaining structure of FIG. 1, and showing the braces connected to upper attachment portions of opposing end walls thereof.
Figure 4:
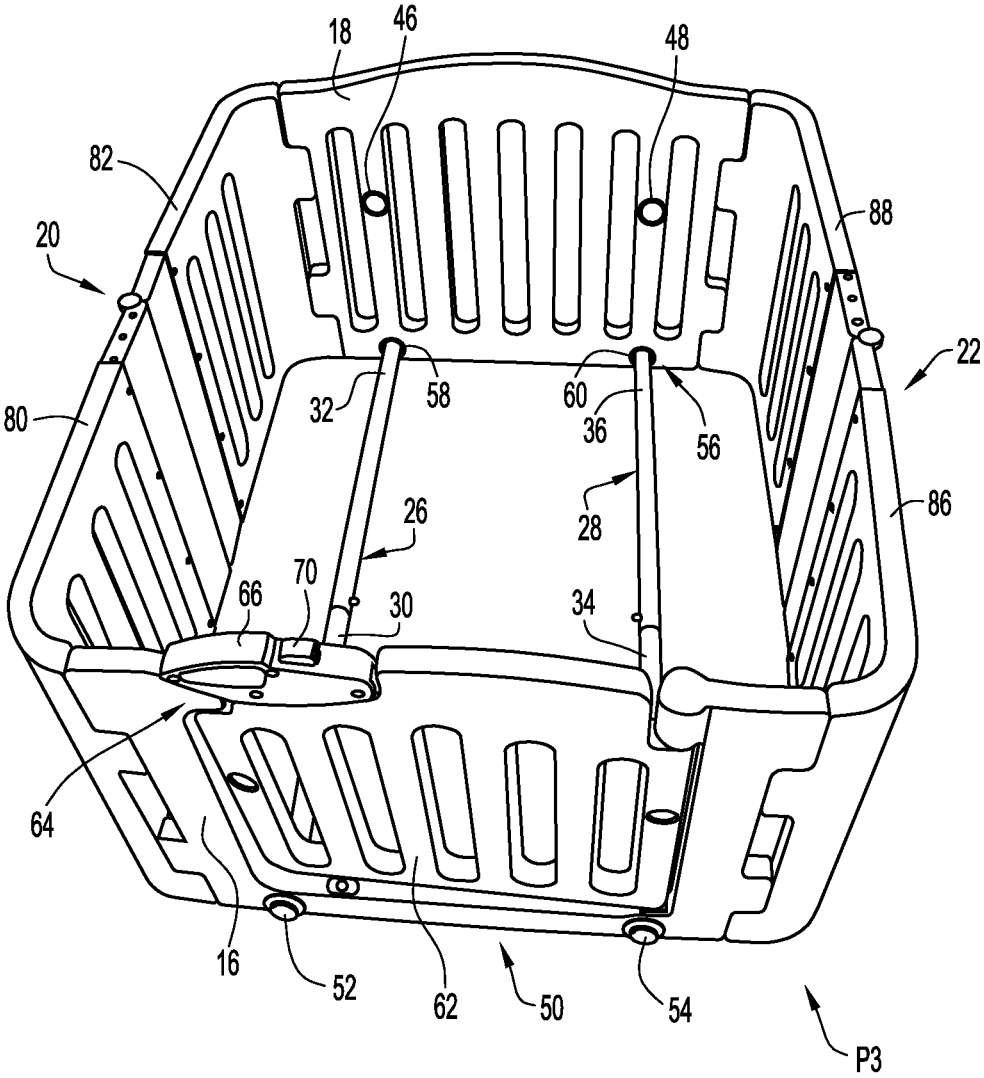
FIG. 4 illustrates a perspective view of the components shown in FIG. 3, and showing the braces connected to lower attachment portions of the opposing end walls.

Referring to FIGS. 3 and 4, one or more support members, such as braces 26, 28, are removably connectable to the opposing end walls 16, 18. The brace 26 includes an end portion 30 connected to the end wall 16 and another opposing end portion 32 connected to the other end wall 18. Similarly, the brace 28 includes an end portion 34 connected to the end wall 16 and another opposing end portion 36 connected to the other end wall 18. In one implementation, the braces 26, 28 are substantially parallel to each other when connected to the end walls 16, 18, and maintain the wall assembly 12 in a substantially rectangular configuration. The braces 26, 28 may be attached to the end walls 16, 18 via screw-on end caps or another suitable attachment method.

The braces 26, 28 may be configured as a pair of bars or tubular members. Each of the braces 26, 28 may include a single unitary bar or tubular member, or include two or more bars or tubular members coupled together. For example, each brace 26, 28 may include two sections 26*a*, 26*b* and 28*a*, 28*b*, respectively, which are connected together via friction fit, pins, detents, etc. The sections 26*a*, 26*b* and 28*a*, 28*b* may be decoupled for storage or transport.

As shown in FIG. 3, an upper portion 38 of end wall 16 includes or defines upper attachment portions 40, 42 (e.g. openings) configured to receive the corresponding ends 30, 34 (shown in FIG. 4) of the braces 26, 28. Similarly, an upper portion 44 of the other end wall 18 includes or defines upper attachment portions 46, 48 (e.g. openings) configured to receive the corresponding other ends 32, 36 of the braces 26, 28. As shown in FIG. 4, a lower portion 50 of end wall 16 includes or defines lower attachment portions 52, 54 (e.g. openings) configured to receive the corresponding ends 30, 34 of the braces 26, 28, and a lower portion 56 of the other end wall 18 includes or defines lower attachment portions 58, 60 (e.g. openings) configured to receive the other ends 32, 36 of the braces 26, 28.

The platform 24 is supported on the braces 26, 28, as shown in FIGS. 1 and 2. When the braces 26, 28 are connected to the upper attachment portions 40, 42 and 46, 48 of the end walls 16, 18, respectively (shown in FIG. 3), the platform 24 is supported in its raised position P1 (shown in FIG. 1). When the braces 26, 28 are connected to the lower attachment portions 52, 54 and 58, 60 of the end walls 16, 18, respectively (shown in FIG. 4), the platform 24 is supported in its lowered position P2 (shown in FIG. 2).

Thus, the braces 26, 28 and platform 24 are repositionable so that the child retaining structure 10 may operate in either its bassinet mode M1 or its playpen mode M2. The braces 26, 28 and platform 24 are sufficiently rigid to accommodate the weight of a child received in the child receiving area 14. For example, the braces 26, 28 may be formed from a plastic or metal material. The platform 24 may include a rigid plastic, wood, fiberboard, etc. base or plate, with a soft or flexible cover (e.g. a vinyl or fabric cover), so that the surface of the platform 24 on which the child lies or stands is relatively soft and comfortable.

With continued reference to FIGS. 3 and 4, in one embodiment, the end wall 16 includes a door 62 pivotal between an open position permitting access through the wall assembly 12 to the child receiving area 14, and a closed position restricting access through the wall assembly 12 to the child receiving area 14. In one implementation, the door 62 includes or defines the upper attachment portions 40, 42 of the end wall 16. As shown in FIG. 3, when the ends 30, 34 of the braces 26, 28 are secured to the upper attachment portions 40, 42 in the door 62 and the other upper attachment portions 46, 48 in the other end wall 18, the door 62 is retained in its closed position and restricted from moving to its open position. Because the braces 26, 28 are connected to the opposing end walls 16, 18, the end walls 16, 18 and thus the door 62 (with the braces 26, 28 attached to the upper attachment portions 46, 48) are maintained in a fixed position relative to each. In this way, the door 62 may not be inadvertently opened when the child retaining structure 10 is disposed in its bassinet mode M1.

The lower attachment portions 52, 54 in the end 16 are spaced from the door 62 (as best seen in FIG. 3), so that the braces 26, 28 are not connected to the door 62 when connected to the lower attachment portions 52, 54 and 58, 60. Thus, when the braces 26, 38 are secured to the lower attachment portions 52, 54 and 58, 60 in the end walls 16, 18, respectively, the door 62 is permitted to move from its closed position to its open position. Thus, the door 62 may be opened when the child retaining structure 10 is disposed in its playpen mode M2.

The end wall 16 may also include a safety latch 64 operably coupled to the door 62. The safety latch 64 is configured to retain the door 62 in its closed position unless actuated by a parent or caregiver. In one implementation, the safety latch 64 includes a lever 66 pivotally movable upwardly and away from the door 62, which releases an associated latch 68 (shown in phantom in FIG. 3) retaining the door 62 in its closed position. The lever 66 is actuatable upon depression of a button 70. Thus, the caregiver must depress the button 70 and lift upwardly on the lever 66 in order to open the door 62, which actions are relatively difficult for a young child to perform. In this way, the possibility of a child undesirably opening the door 62 is minimized.

In one embodiment, once the safety latch 64 is actuated and the door 62 is moved to its open position, it may not then be moved back to its closed position unless the safety latch 64 is again actuated by the care giver. Thus, the safety latch 64 prevents the door 62 from undesirably moving back to its closed position by a child unless the safety latch 64 is actuated by a caregiver.

Figure 5:
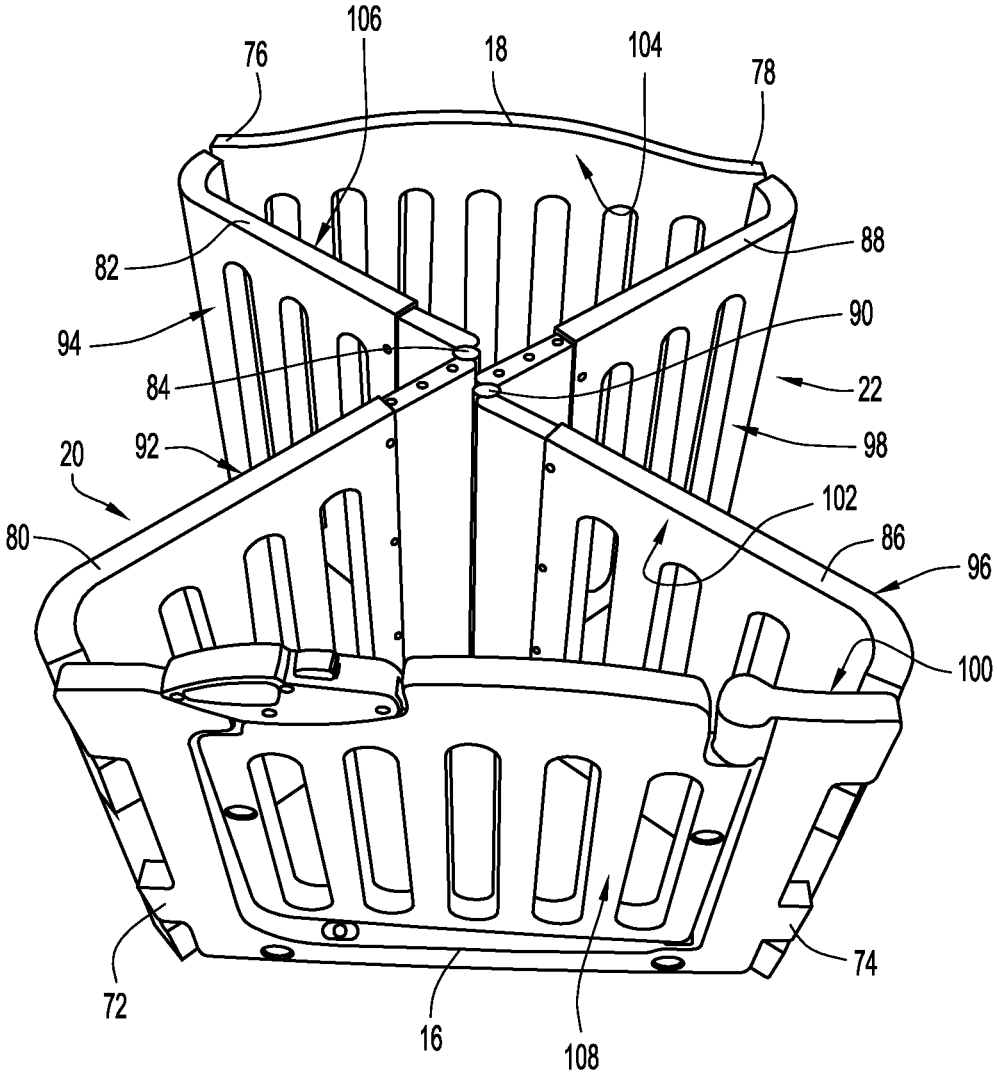
FIG. 5 illustrates a perspective view of the wall assembly of the child retaining structure of FIG. 1 in a partially collapsed orientation.

Referring to FIG. 5, the end wall 16 includes an edge portion 72 hingedly connected to the sidewall 20, and an opposite edge portion 74 hingedly connected to the other sidewall 22. Similarly, the end wall 18 includes an edge portion 76 hingedly connected to the sidewall 20, and an opposite edge portion 78 hingedly connected to the other sidewall 22. In addition, the sidewall 20 includes a first section 80 pivotally connected to a second section 82 via a first hinged coupling 84. The other sidewall 22 includes a third section 86 pivotally connected to a fourth section 88 via a second hinged coupling 90. When the wall assembly 12 is oriented so that the end walls 16, 18 are substantially parallel to each other, the first hinged coupling 84 is axially offset from the second hinged coupling 90. That is, a line drawn through the two hinged couplings 84 and 90 is not parallel to the end walls 16, 18.

Figure 6:
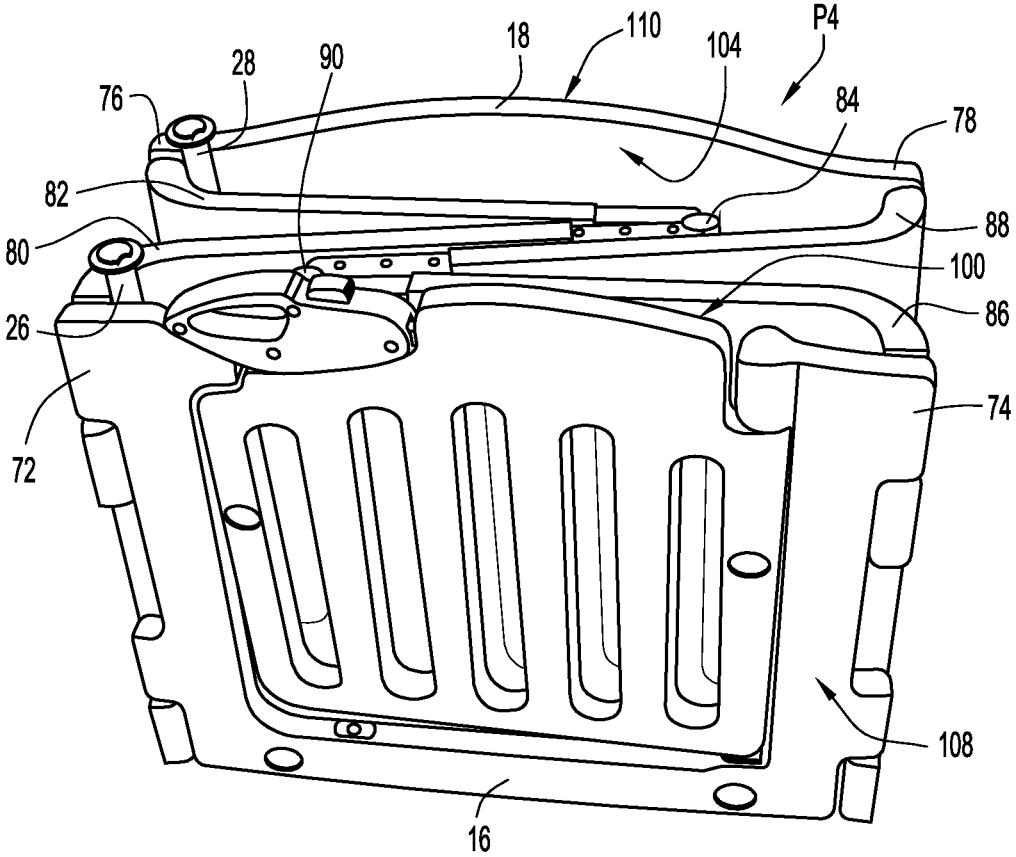
FIG. 6 illustrates a perspective view of the wall assembly of the child retaining structure of FIG. 1 in a folded position.

Referring to FIGS. 3, 4 and 6, the offset configuration of the hinged couplings 84, 90 permits the wall assembly 12 to be reconfigured between a deployed position P3 (shown in FIGS. 3 and 4) and a folded position P4 (shown in FIG. 6). Referring to FIGS. 5 and 6, in order to reconfigure the wall assembly 12 from its deployed position P3 to its folded position P4, the opposing end walls 16, 18 and opposing sidewalls 20, 22 are collapsed inwardly. Outer surfaces 92, 94 of the first and second sections 80, 82 of the sidewall 20 fold toward and against each other, and outer surfaces 96, 98 of the third and fourth sections 86, 88 of the sidewall 22 fold toward and against each other. An inner surface 100 of the end wall 16 is collapsed toward an inner surface 102 of the third section 86, and an inner surface 104 of the end wall 18 is collapsed toward an inner surface 106 of the second section 82.

As shown in FIG. 6, the major surfaces (i.e. inner surfaces 100, 104 and opposing outer surfaces 108, 110) of the end walls 16, 18 are substantially parallel to each other when the wall assembly 12 is disposed in its folded position P4. The sidewalls 20, 22 are permitted to fold into and against each other due to the axially offset orientation of the first and second hinged couplings 84, 90 (as shown in FIGS. 5 and 6).

As shown in FIGS. 3 and 4, when the wall assembly 12 is disposed in its deployed position P3 and the braces 26, 28 are connected to the opposing end walls 16, 18, the first and second sections 80, 82 of the sidewall 20 are substantially coplanar and the third and fourth sections 86, 88 of the sidewall 22 are substantially coplanar. Further, in the deployed position P3, the sidewall 20 is substantially parallel to the opposing sidewall 22, the end wall 16 is substantially parallel to the opposing end wall 18, and the end walls 16, 18 are substantially perpendicular to the sidewalls 20, 22. When connected to the wall assembly 12, the braces 26, 28 restrict pivotal movement between the end walls 16, 18 and the sidewalls 20, 22, as well as pivotal movement between the first and second sections 80, 82 and the third and fourth sections 86, 88 of the sidewalls 20, 22, respectively. Thus, the wall assembly 12 is maintained in its substantially rectangular configuration by the braces 26, 28. The addition of the platform 24 to the system increases rigidity of the substantially rectangular configuration of the child retaining structure 10.

Figure 7:
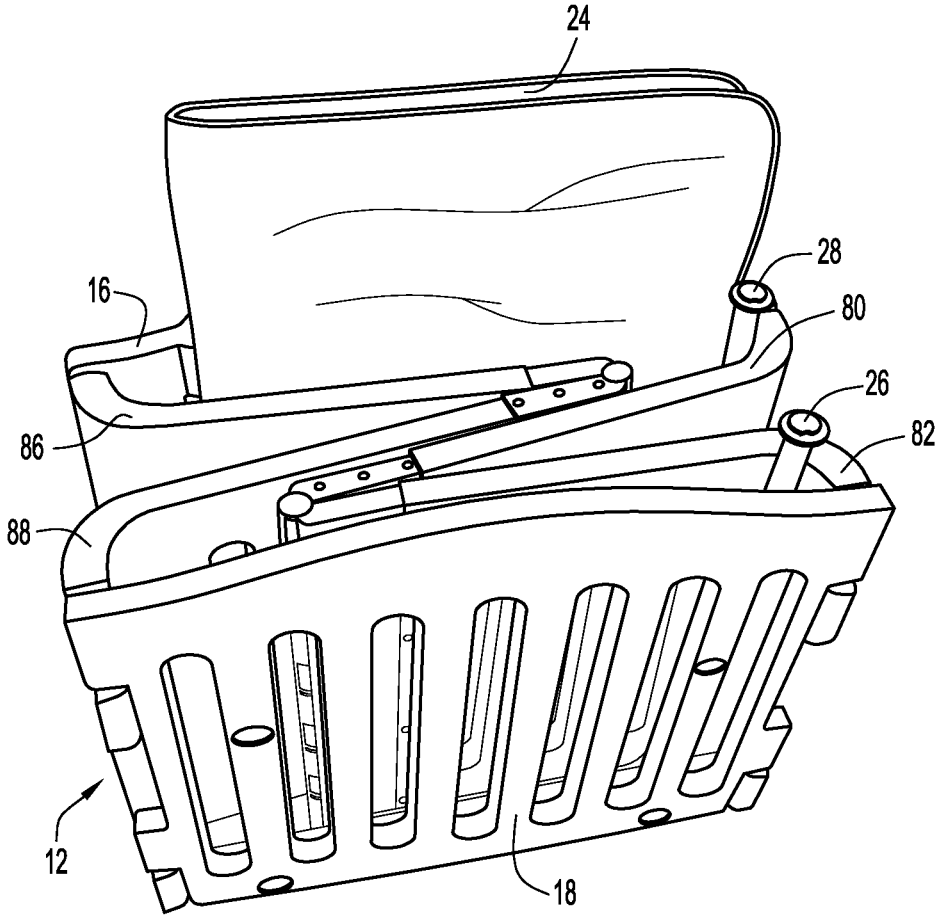
FIG. 7 illustrates a perspective view of the child retaining structure of FIG. 1 in a collapsed orientation for storage or transport.

Referring again to FIG. 6, the footprint of the wall assembly 12 is substantially reduced when collapsed to its folded position P4. In addition, the sections 26*a*, 26*b* and 28*a*, 28*b* of the braces 26, 28 may be decoupled or collapsed (e.g., such as telescopically), and the resulting sections 26*a*, 26*b*, 28*a*, 28*b* retained between the end walls 16, 18 and the sidewalls 20, 22 of the wall assembly 12. As shown in FIG. 7, the platform 24 may also be foldable and inserted between one of the end walls 16 (or 18) and corresponding section (e.g., third section 86) of the sidewall 22 (or 20). In this way, the child retaining structure 10 may be easily collapsed for storage or transport, and all components maintained together for easy re-deployment as desired.

In the bassinet mode M1 (shown in FIG. 1) and/or the playpen mode M2 (shown in FIG. 2), an arched toy bar 112 may be coupled to the opposing sidewalls 20, 22. For example, opposing ends 114, 116 of the arched toy bar may include clips, clamps, or engagement portions, which are coupleable to correspondingly configured portions of the sidewalls 20, 22. The arched toy bar 112 may include one or more entertainment elements 118, 120, 122, which hang over the child retaining area 14 when the toy bar 112 is coupled to the wall assembly 12.

The child retaining structure 10 may also include an activity panel 124 (shown in phantom in FIG. 2), which may for example be coupled to or defined by the inner surface 104 of the end wall 18 (and/or another of the end wall 16 and/or side walls 20, 22). Thus, the activity panel 124 is disposed within the child receiving area 14 and accessible by a child retained therein.

Figure 8:
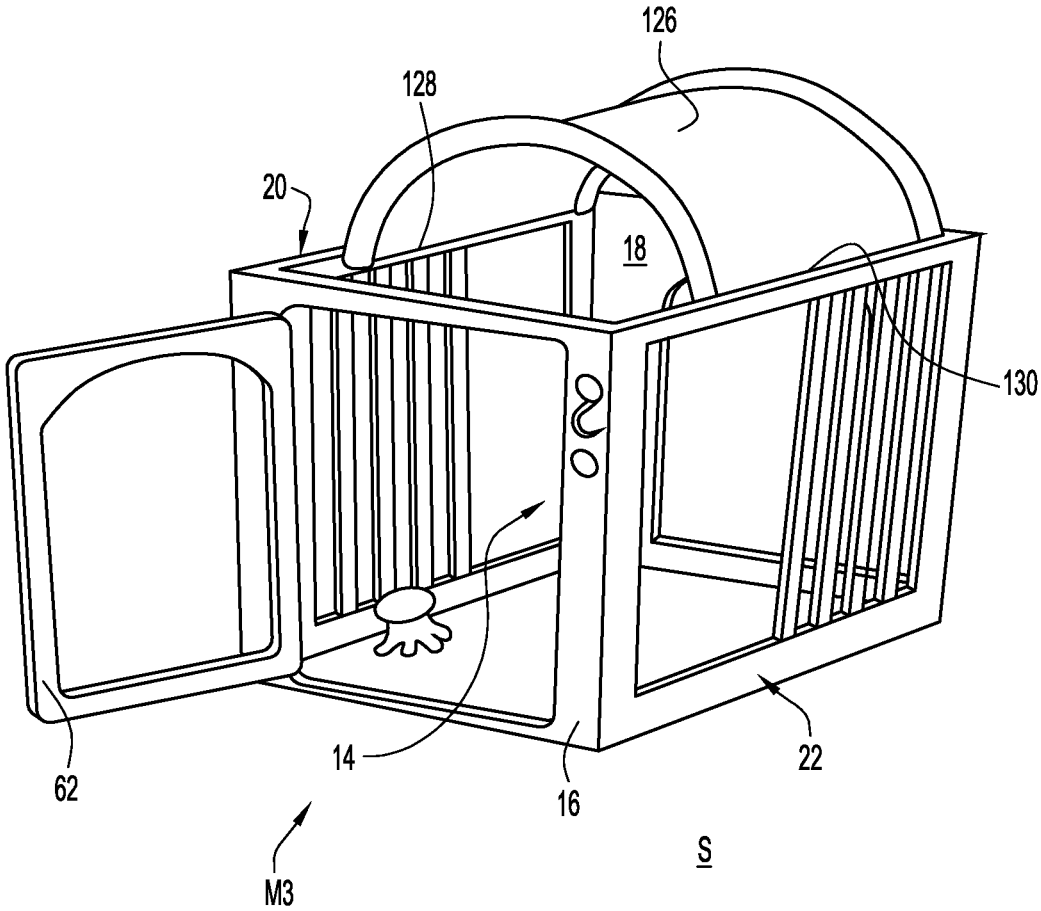
FIG. 8 illustrates a child retaining structure according to another embodiment, and configured in a play house mode.

Referring to FIG. 8, in one embodiment, the child retaining structure 10 may also be reconfigured to function in a playhouse mode M3. In the playhouse mode M3, the braces 26, 28 and the platform 24 may be connected to the opposing end walls 16, 18 so that the braces 26, 28 are proximate to or rest on the support surface S. For example, the opposing end walls 16, 18 may include auxiliary attachment portions (e.g. openings), which receive corresponding ends 30, 34 and 32, 36 of the braces 26, 28, so that the platform 24 is supported on the braces 26, 28 in a lowered, third position.

Alternatively, the braces 26, 28 may be coupled to lower attachment portions 52, 54, 58, 60, as described above. Alternatively, the braces 26, 28 may be removed, and the platform 24 positioned within the child retaining area 14 and disposed against the support surface S. Alternatively, both the braces 26, 28 and the platform 24 may be removed. In any case, the door 62 is permitted to move between its open and closed positions when the child retaining structure 10 is in its playhouse mode M3.

An arched roof 126 may be coupled to the opposing sidewalls 20, 22 (or opposing end walls 16, 18). For example, the arched roof 126 may include an edge 128 which is coupled or releasably fastened to the sidewall 20 via clips, brackets, etc., and another edge 130 which is coupled or releasably fastened to the other sidewall 22 via clip, brackets, etc. The arched toy bar 112 and/or activity panel(s) 124 may also be utilized in the playhouse mode M3.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. For example, although opposing end walls 16, 18 and opposing sidewalls 20, 22 have been illustrated as being formed from a rigid material, any of these walls could also comprise fabric or some other cloth-like material stretched over a rigid tubular perimeter frame. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A child retaining structure, comprising:

a wall assembly including opposing first and second end walls and opposing first and second sidewalls, said wall assembly defining a child receiving area;

a brace removably connectable to said opposing first and second end walls in a first position and in a second position; and a platform supported on said brace in said first position so that the child retaining structure functions as a bassinet, or said platform supported on said brace in said second position so that the child retaining structure functions as a playpen, wherein said first end wall includes a door pivotable between an open position permitting access through said wall assembly to said child receiving area and a closed position restricting access through said wall assembly to said child receiving area, and wherein said door is retained in its closed position when said brace is connected to said opposing first and second end walls in said first position.

2. The child retaining structure of claim 1, wherein said brace is removably connectable to said opposing first and second end walls in a third position, said platform supported on said brace in said third position so that the child retaining structure functions as a playhouse.

3. The child retaining structure of claim 2, further comprising an arched roof member extending between and removably connected to said opposing first and second sidewalls.

4. The child retaining structure of claim 1, wherein a first end of said brace is connected to said door and an opposite second end of said brace is connected to said second end wall.

5. The child retaining structure of claim 1, further comprising a safety latch operably coupled to said door and configured to retain said door in said closed position unless actuated by a care giver.

6. The child retaining structure of claim 5, wherein, once said door is disposed in its open position, said safety latch prevents said door from moving back to its closed position unless said safety latch is actuated.

7. The child retaining structure of claim 1, wherein said brace is a first brace, further comprising a second brace connected to and extending between said opposing first and second end walls.

8. The child retaining structure of claim 1, wherein said first and second end walls are hingedly connected to said first and second sidewalls.

9. The child retaining structure of claim 8, wherein said first sidewall includes a first section pivotally connected to a second section via a first hinged coupling, and said second sidewall includes a third section pivotally connected to a fourth section via a second hinged coupling.

10. The child retaining structure of claim 9, wherein said first hinged coupling is offset from said second hinged coupling, so that said wall assembly is reconfigurable between a deployed position and a folded position.

11. The child retaining structure of claim 10, wherein said opposing first and second end walls and said first and second sidewalls are collapsed inwardly when said wall assembly is disposed in its folded position.

12. The child retaining structure of claim 11, wherein major surfaces of said first and second end walls are substantially parallel to each other when said wall assembly is disposed in its folded position.

13. The child retaining structure of claim 1, further comprising an arched toy bar extending between and removably connected to said opposing first and second sidewalls.

14. The child retaining structure of claim 1, further comprising an activity panel coupled to an interior surface of said wall assembly and within said child receiving area.

15. A child retaining structure, comprising:

a first end wall including a first opening;

a second end wall including a second opening;

a first sidewall including a first section hingedly connected to said first end wall and a second section hingedly connected to said second end wall, said first section pivotally connected to said second section via a first hinged coupling;

a second sidewall including a third section hingedly connected to said first end wall and a fourth section hingedly connected to said second end wall, said third section pivotally connected to said fourth section via a second hinged coupling, said second hinged coupling offset from said first hinged coupling, wherein said end walls and sidewalls cooperate to define a child receiving area;

a first brace connected to each of the first end wall and the second end wall, the first brace being disposed in spaced relation from the side walls; and a second brace connected to each of the first end wall and the second end wall, the second brace being disposed in spaced relation from the side walls, wherein at least one of the first brace and the second brace spans the child receiving area, the at least one brace being received by the first and second openings of the end walls, and wherein the first brace and the second brace restrict pivotal movement of the end walls.

16. The child retaining structure of claim 15, further comprising a support member removably connectable to said first and second end walls, wherein said first and second sections of said first sidewall are substantially coplanar when said support member is connected to said first and second end walls.

17. The child retaining structure of claim 16, wherein said third and fourth sections of said second sidewall are substantially coplanar and said first sidewall is substantially parallel to said second sidewall when said support member is connected to said first and second end walls.

18. The child retaining structure of claim 15, wherein each of the first brace and the second brace span the child receiving area.

19. The child retaining structure of claim 15, wherein each brace is connected to an end wall at an inboard end wall position.

20. The child retaining structure of claim 15, wherein:

each brace defines a first end and a second end;

each brace spans the child receiving area; and each end of each brace is connected to its corresponding end wall at an inboard end wall position.

* * * * *